US007516950B2

(12) United States Patent
Herde et al.

(10) Patent No.: US 7,516,950 B2
(45) Date of Patent: Apr. 14, 2009

(54) CUT SHEET FEEDER

(75) Inventors: Kevin Herde, Kent, CT (US); Thomas Nguyen, Trumbull, CT (US); Egbert E. Most, Southbury, CT (US); Rebecca J. Anderson, Pawling, NY (US); Charles C. Fuller, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 457 days.

(21) Appl. No.: 11/397,161

(22) Filed: Apr. 4, 2006

(65) Prior Publication Data

US 2006/0267265 A1 Nov. 30, 2006

Related U.S. Application Data

(60) Provisional application No. 60/686,107, filed on May 31, 2005.

(51) Int. Cl.
*B65H 83/00* (2006.01)

(52) U.S. Cl. ..... 271/3.01; 271/3.07; 271/3.12

(58) Field of Classification Search ..... 271/3.01, 271/3.03, 3.05, 3.07, 3.12, 3.13, 99, 105
See application file for complete search history.

(56) References Cited

U.S. PATENT DOCUMENTS 3,674,258 A * 7/1972 Maier et al. ..... 271/202
4,674,733 A * 6/1987 Pessina et al. ..... 271/3.07
5,088,717 A * 2/1992 Hamanaka et al. ..... 271/98
5,116,303 A 5/1992 Dietrich et al. ..... 493/313
5,145,161 A 9/1992 Bowser et al. ..... 271/12
5,265,868 A 11/1993 Bowser et al. ..... 271/274
5,464,203 A 11/1995 Bowser et al. ..... 271/12
5,476,255 A 12/1995 Murcko et al. ..... 271/109
5,575,463 A * 11/1996 Parkander ..... 270/52.02
5,702,097 A 12/1997 Bakoledis ..... 270/58.06

(Continued)

FOREIGN PATENT DOCUMENTS

EP 893383 A2 10/1998

(Continued)

*Primary Examiner*—Patrick Mackey
*Assistant Examiner*—Thomas A Morrison
(74) *Attorney, Agent, or Firm*—Brian A. Collins; Angelo N. Chaclas

(57) ABSTRACT

A cut sheet feeder for feeding stacked sheets of material including a feed support deck defining a planar surface for supporting the stacked sheet material and a transport deck defining an inclined surface relative to the planar surface of the feed support deck. The inclined surface is operative to transport additional sheet material to the feed support deck and produce a cantilevered sheet material delivery profile. Furthermore, a rotating element is employed to engage a surface of the stacked sheet material, and separate a single sheet from other sheet material supported by the feed support deck. The cantilevered delivery profile reduces the weight acting on the stacked material, minimizes the friction developed between individual sheets of material and facilitates separation of the sheets by the rotating element. A platen structure may also be employed to bear against the stacked sheet material to ensure reliable sheet material run out. That is, the platen structure serves to equilibrate or compensate for a lessening of sheet material weight as the final or last sheets of the stack are singulated or separated by the rotating element.

18 Claims, 6 Drawing Sheets

U.S. PATENT DOCUMENTS

| | | | | |
|---|---|---|---|---|
| 5,818,724 | A | 10/1998 | Brewster et al. | 364/478.08 |
| 5,966,302 | A | 10/1999 | Chrosny et al. | 364/148.03 |
| 6,142,462 | A | 11/2000 | Moser et al. | 271/157 |
| 6,158,732 | A | 12/2000 | Tomiyama et al. | 271/31.1 |
| 6,279,895 | B1 * | 8/2001 | Tranquilla | 271/35 |
| 6,305,684 | B1 | 10/2001 | Lightner et al. | 271/122 |
| 6,354,583 | B1 | 3/2002 | Skadow et al. | 271/10.03 |
| 6,637,740 | B2 * | 10/2003 | Pessina et al. | 271/3.03 |
| 6,644,659 | B2 | 11/2003 | Skadow et al. | 271/265.02 |
| 6,702,281 | B2 * | 3/2004 | Post et al. | 271/258.01 |
| 6,758,616 | B2 | 7/2004 | Pribula et al. | 400/624 |
| 6,779,792 | B2 | 8/2004 | Lyga et al. | 271/273 |
| 6,932,527 | B2 | 8/2005 | Pribula et al. | 400/621 |
| 2002/0079635 | A1 * | 6/2002 | Pessina et al. | 271/3.01 |
| 2004/0245716 | A1 * | 12/2004 | Bates et al. | 271/276 |

FOREIGN PATENT DOCUMENTS

| | | | |
|---|---|---|---|
| EP | 219552 | A1 | 3/2002 |

* cited by examiner

CUT SHEET FEEDER

RELATED APPLICATIONS

This application claims the benefit of U.S. Provisional Application Serial No. 60/686,107 , filed May 31, 2005 , the specification of which is hereby incorporated by reference. This application also relates to commonly-owned, co-pending Utility Patent Publication Number 2006/0267272 entitled "PLATEN FOR CUT SHEET FEEDER".

TECHNICAL FIELD

The present invention relates generally to an apparatus for feeding sheets of material, and, more particularly, to a new and useful apparatus for feeding cut sheets of material into a mailpiece inserter system. The cut sheet feeder reliably singulates material at high feed rates without distorting or jamming the sheet material.

BACKGROUND OF THE INVENTION

A mail insertion system or a "mailpiece inserter" is commonly employed for producing mailpieces intended for use in the mailstream. Such mailpiece inserters are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mailpiece are substantially identical with respect to each addressee.

In many respects, a typical inserter system resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. Typically, inserter systems prepare mail pieces by arranging preprinted sheets of material into a collation, i.e., the content material of the mail piece, on a transport deck. The collation of preprinted sheets may continue to a chassis module where additional sheets or inserts may be added based upon predefined criteria, e.g., an insert being sent to addressees in a particular geographic region. Subsequently, the collation may be folded and placed into envelopes. Once filled, the envelopes are closed, sealed, weighed, and sorted. A postage meter may then be used to apply postage indicia based upon the weight and/or size of the mail piece.

One module, to which the present invention is directed, relates to the input section of an inserter wherein mailpiece sheet material is stacked in a shingled arrangement and singulated for creation of a mailpiece. In this module, the sheets are individually handled for collation, folding, insertion or other handling operation within the mailpiece insertion system to produce the mailpiece. Typically, the sheets are spread/laid over a horizontal transport deck and slowly conveyed to a rotating vacuum drum or cylinder which is disposed along the lower surface or underside of the sheet material. Furthermore, the leading edge of the stacked sheet material abuts and rests against a stationary stripper which is disposed above and slightly aft of the drum (i.e., its rotational axis).

The rotating vacuum drum/cylinder incorporates a plurality of apertures in fluid communication with a vacuum source for drawing air and developing a pressure differential along the underside of each sheet. As a sheet is conveyed along the deck, the leading edge thereof, disposed parallel to the axis of the vacuum cylinder, is brought into contact with the outer surface of the vacuum cylinder. The pressure differential produced by the vacuum source draws the sheet into frictional engagement with the cylinder and separates/singulates individual sheets from the stack by the rotating motion of the vacuum cylinder. That is, an individual sheet is separated from the stack by the vacuum drum/cylinder and is singulated, relative to the stacked sheets above, as the sheet follows a tangential path relative to the rotating circular drum.

Singulation may be augmented by a blower which introduces pressurized air between the sheets to separate the sheets as they frictionally engage the rotating drum/cylinder. That is, an air plenum may be disposed along each side of the stacked sheets to pump air between the sheets and reduce any fiber adhesion or interlock which may develop between the sheet material.

The rate of mailpiece fabrication is essentially limited by or to the speed of an inserter's least productive module (i.e., in terms of mailpiece throughput). Consequently, it is generally desirable to mitigate or eliminate sheet transport or transfer limitations wherever possible. While the various systems/mechanical apparatus discussed above greatly increase the rate of singulation, the transfer rate can be limited by the frictional interface developed between the stacked sheets of material. Such limitations, it will be appreciated, can adversely affect the rate or throughput of mailpiece fabrication.

A need, therefore, exists for a high throughput sheet feeder which mitigates or minimizes friction or adhesion between sheet material during singulation.

SUMMARY OF THE INVENTION

A cut sheet feeder is provided for feeding stacked sheets of material including a feed support deck defining a planar surface for supporting the stacked sheet material and a transport deck defining an inclined surface relative to the planar surface of the feed support deck. The inclined surface is operative to transport additional sheet material to the feed support deck and produce a cantilevered sheet material delivery profile. Furthermore, a rotating element is employed to engage a surface of the stacked sheet material, and separate a single sheet from other sheet material supported by the feed support deck. The cantilevered delivery profile reduces the weight acting on the stacked material, minimizes the friction developed between individual sheets of material and facilitates separation of the sheets by the rotating element. A platen structure may also be employed to bear against the stacked sheet material to ensure reliable sheet material run out. That is, the platen structure serves to equilibrate or compensate for a lessening of sheet material weight as the final or last sheets of the stack are singulated or separated by the rotating element.

BEST MODE TO CARRY OUT THE INVENTION

The sheet feeding apparatus of the present invention is described in the context of a mailpiece inserter system, though, it should be understood that the invention is applicable to any sheet feeding apparatus wherein sheets must be separated or singulated for subsequent handling or processing. The use of the sheet feeding apparatus for the purpose of fabricating/producing mailpieces is merely illustrative of an exemplary embodiment and the inventive teachings should be broadly interpreted in view of the appended claims of the specification.

Figure 1:
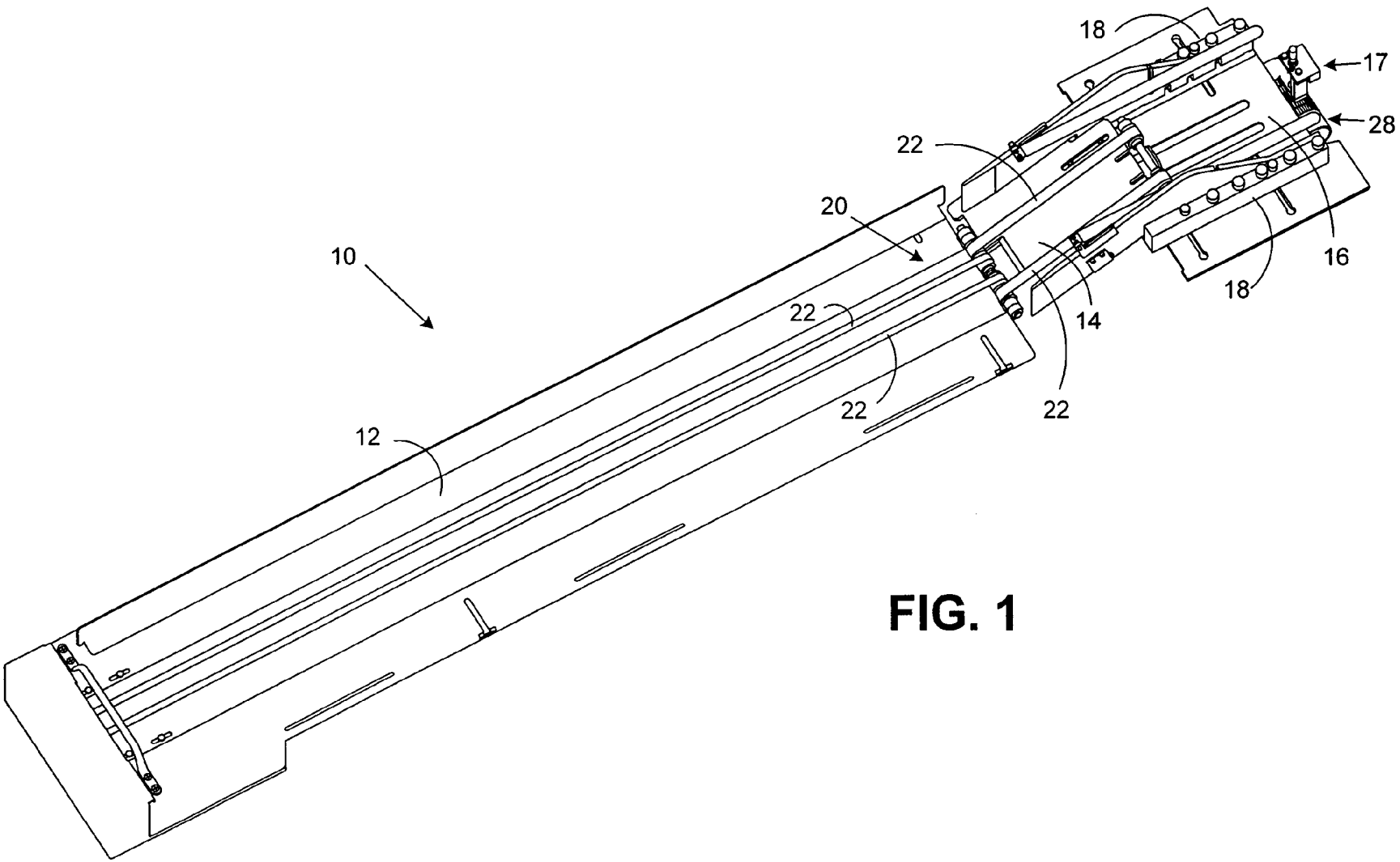
FIG. 1 depicts an isolated perspective view of the relevant components of the cut sheet feeder according to the present invention including a horizontal transport deck, an inclined transport deck, a feed support deck, and an air plenum disposed in combination with the feed support deck.
Figure 2:
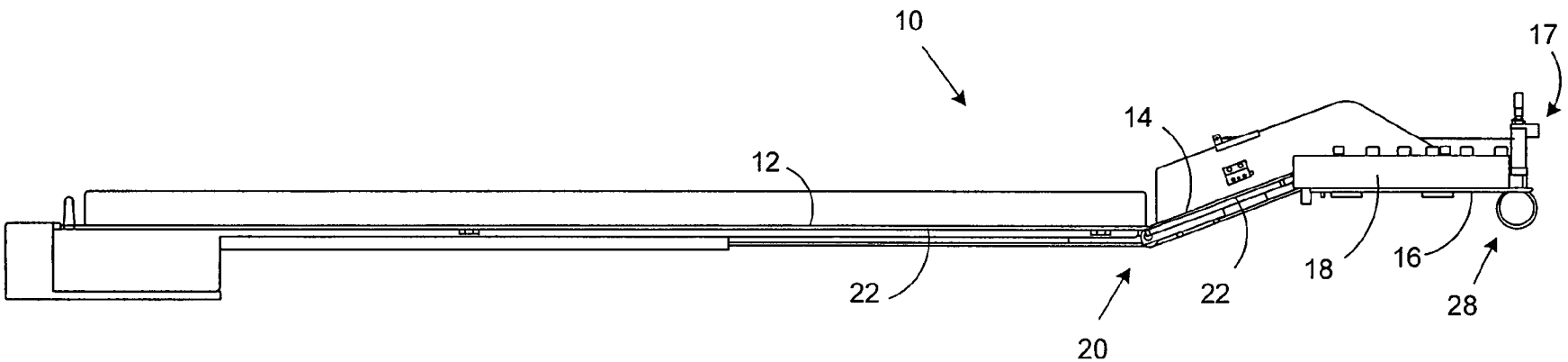
FIG. 2 depicts a profile view of the cut sheet feeder of FIG. 1.

FIGS. 1 and 2 show a perspective top view and side view, respectively, of a cut sheet feeder 10 according to the present invention and includes a horizontal transport deck 12, and inclined transport deck 14, a feeder support deck 16, and an air plenum 18 disposed in combination with the feed support deck 14. Both the horizontal and inclined transport decks 12, 14 include a conveyor system 20, i.e., typically a belt or chain 22 disposed and driven by an arrangement of pulleys (not shown) beneath the deck, for transporting sheet material along the decks 12, 14.

Figure 3:
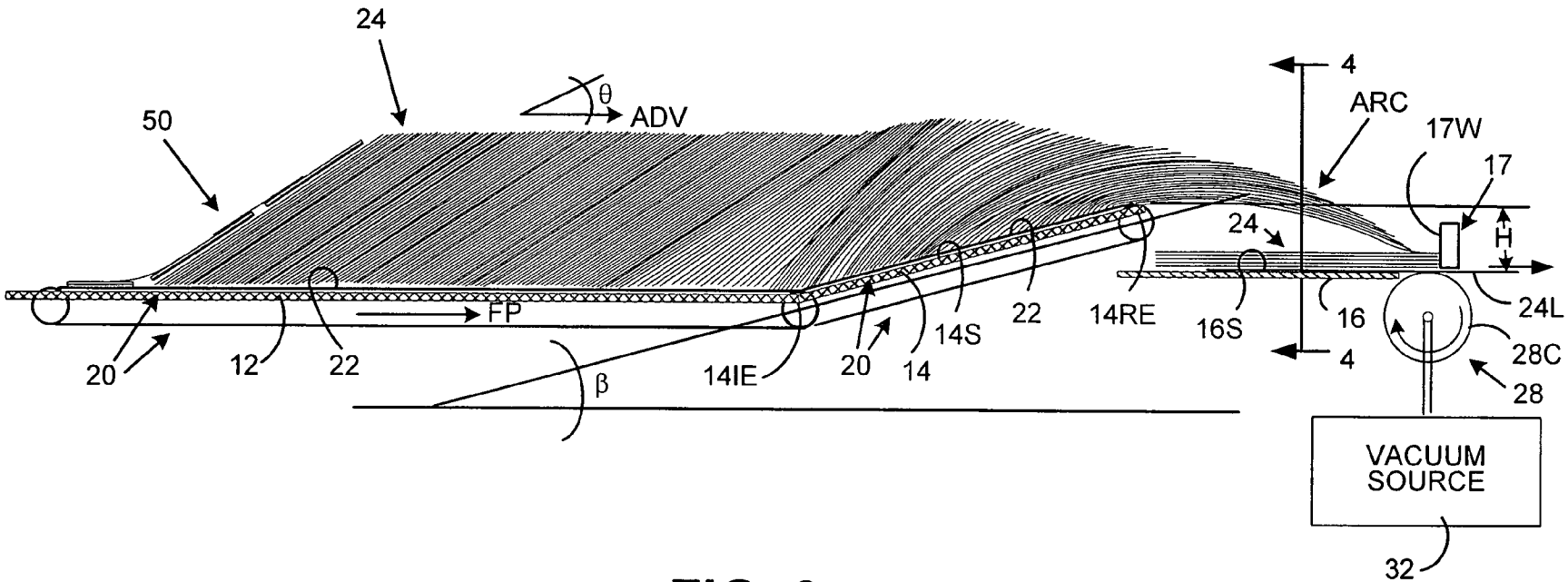
FIG. 3 depicts a broken away side view of the cut sheet feeder revealing additional structure including a rotating vacuum drum/cylinder and stripping/retaining device for singulating stacked sheet material.

Before discussing the operation and advantages of the cut sheet feeder 10, it will be useful to describe in both general and specific terms, the structural elements of the cut sheet feeder 10 and the spatial relationship of these various structural elements. More specifically, and referring to FIG. 3, cut sheets of material 24 (hereinafter referred to as "sheet material") are laid atop the transport decks 12, 14 in a shingled arrangement, i.e., forming an acute angle θ relative to the advancing side of the deck 12, in the direction of arrow ADV. The horizontal transport deck 12 is aligned with and directs sheet material 24 along a feed path FP to the lower or input end of the inclined transport deck 141E.

The inclined transport deck 14 defines an upwardly sloping inclined surface 14S which defines an angle β relative to the planar surface 16S of the feed support deck 16. The acute angle β formed is preferably within a range of about sixteen degrees (16°) to about thirty degrees (30°), though, in certain embodiments, the range may be more preferably between about sixteen degrees (16°) to about twenty-four degrees (24°). For example, and with respect to the more precise range of angles β, when feeding sheet material used in the creation of mailpieces, it was determined that an angle β of twenty degrees (20°) was optimum for effecting transport and subsequent singulation of the sheet material 24.

The feed support deck 16 is aligned with and disposed below the raised end of the 14RE of the inclined transport deck 14. While the elevation H of the inclined deck 14 to the feed support deck 16 depends upon the stiffness characteristics of the stacked sheet material 24 (i.e., in its shingled arrangement), the preferred elevation H is a height determined by the "cantilevered delivery profile" ARC of the sheet material 24. In the context used herein, the phrase "cantilevered delivery profile" means the arc-shaped profile which develops when the sheet material 24 is supported at one end (i.e., by the interleaved/shingled arrangement of the sheets) and unsupported at the other end (i.e., resulting in a vertical droop under the force of gravity). The vertical droop of the cantilevered delivery profile ARC may be used to approximate the vertical elevation H of the inclined transport deck 14 relative to the feed support deck 16.

A rotating element 28 defining a cylindrical surface 28C is disposed proximal to one end of the feed support deck 16 such that the planar surface 16S thereof is tangentially aligned with the cylindrical surface 28C of the rotating element 28. In the described embodiment, the rotating element 28 is a vacuum drum having plurality of perforations and a vacuum source 32 disposed in fluid communication with the vacuum drum 28. More specifically, the vacuum source 32 is operative to develop a pressure differential which, as will be described in greater detail below, functions to draw a leading edge segment of the sheet material 24 into frictional engagement with the cylindrical surface 28C of the vacuum drum 28.

A stripper/retainer device 17 is used in combination with the rotating element/vacuum drum 28 ensure that a single sheet 24S is moved or removed from the stacked sheet material 24. More specifically, the stripper/retainer 17 is disposed above the vacuum drum 28 and positioned just slightly downstream of its rotational axis 28A, i.e., a relatively small distance on the order of one-quarter (0.25) inches. As such, a lower edge of the stripper/retainer 17 is located at or below the horizontal line of tangency with the cylindrical surface 28C of the drum 28.

In operation, the sheet material 24 is stacked on the one or both of the transport decks 12, 14 and conveyed to the feed support deck 16. As sheet material 24 reaches the raised end 14RE the inclined deck 14, the sheet material 24 forms or develops the cantilevered delivery profile ARC and is conveyed to the feed support deck 16. The sheet material 24 forms a small stack or thickness of sheet material 24 on the feed support deck 16 while the sheet material above is supported by the inclination of the transport deck 14. The vacuum drum 28 develops a pressure differential across the lowermost sheet 24L of material 24, i.e., the sheet in contact with the feed support deck 16, and, upon rotation, separates or singulates this sheet 24L from the remainder of the stack.

Specifically, the leading edge 24LE of the stacked sheet material 24 engages the stripper/retainer 17, as the vacuum drum 28 draws a single sheet 24L below the lowermost edge of the stripper/retainer 17. The lowermost sheet 24L is "stripped" away from the stacked sheet material 24 and moves past the stripper/retainer 17 while the remaining sheets 24 are "retained" by the vertical wall or surface 17S of the stripper/retainer 17. The separated/singulated sheet 24L moves tangentially across the cylindrical surface 28C of the vacuum drum 28 to an input station (not shown) of a processing module, e.g., of a mailpiece insertion system.

Figure 4:
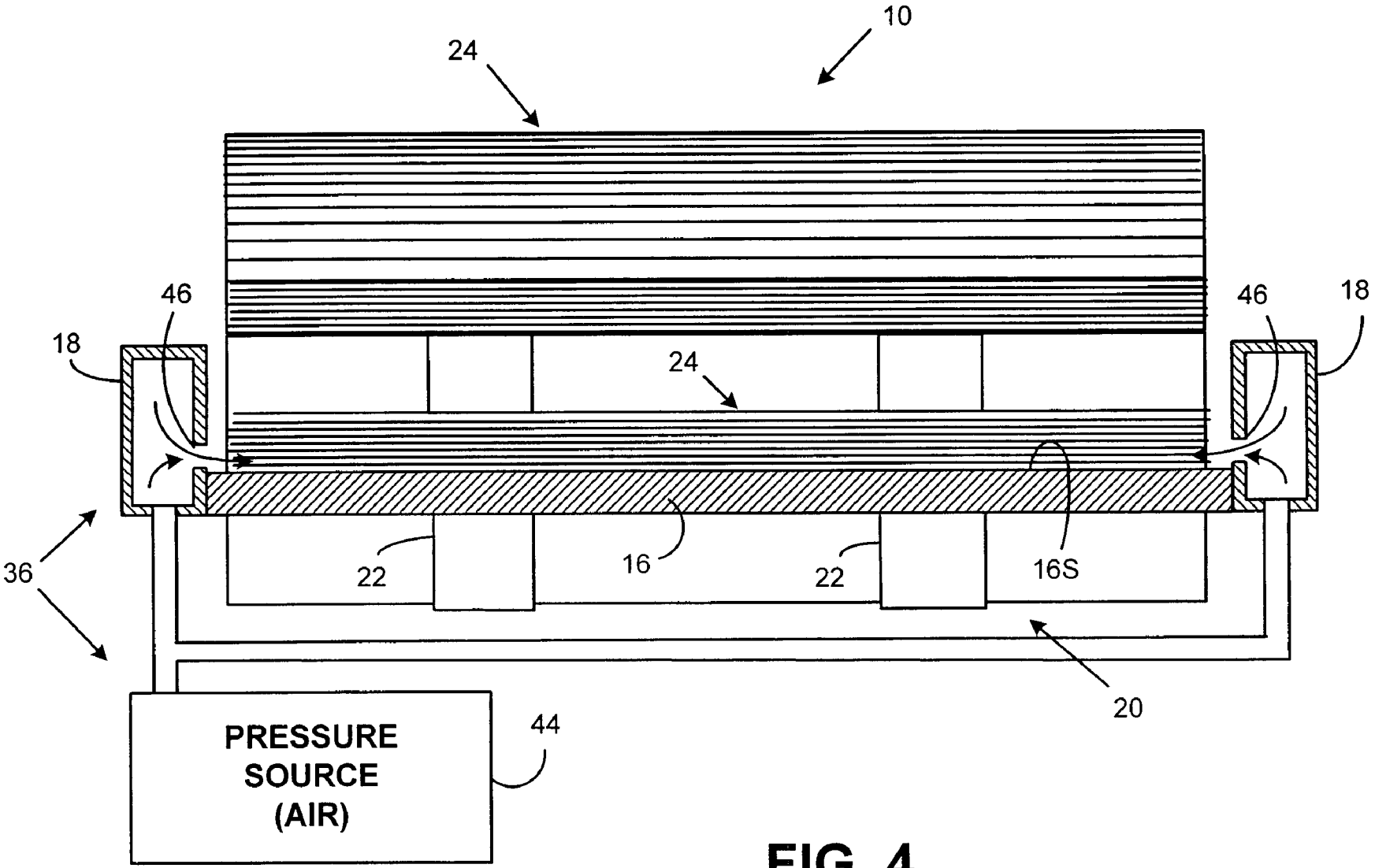
FIG. 4 is a sectional view taken substantially along line 4-4 of FIG. 3 showing the flow of pressurized air supplied by air plenums disposed to each side of the stacked sheet material.
Figure 5A:
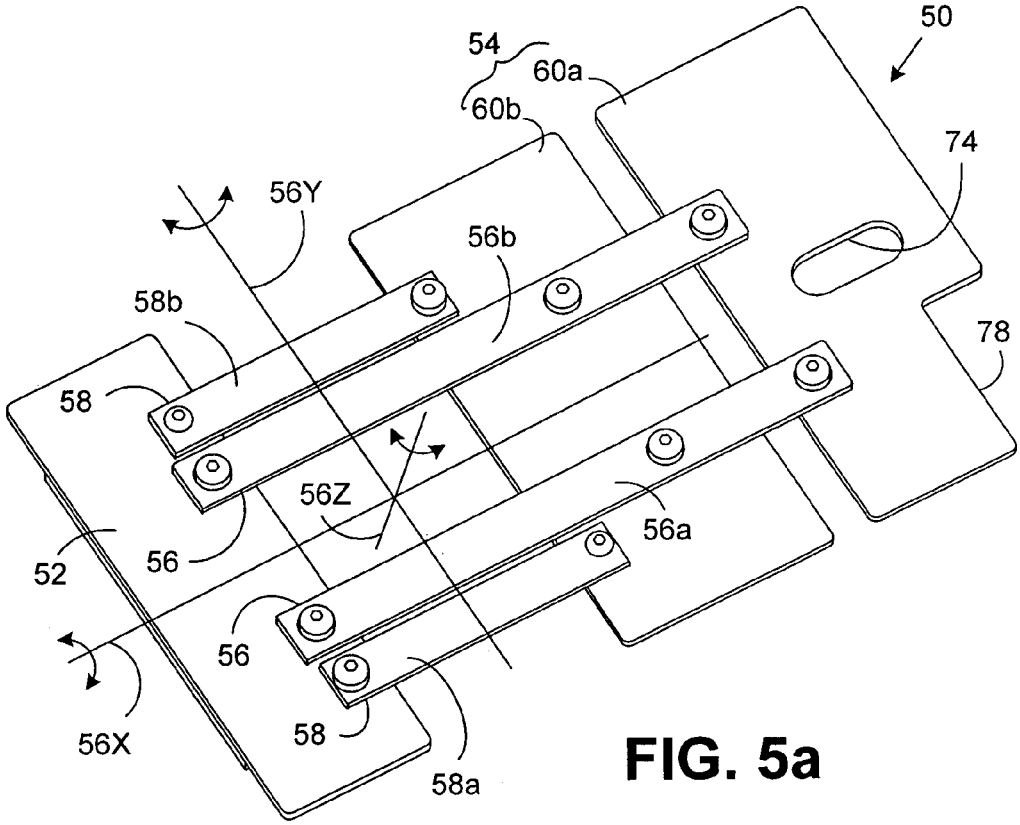
FIG. 5*a* is an isolated perspective view of a platen structure used for ensuring run out of the stacked sheet material as the cut sheet feeder completes a mailpiece job run.
Figure 5B:
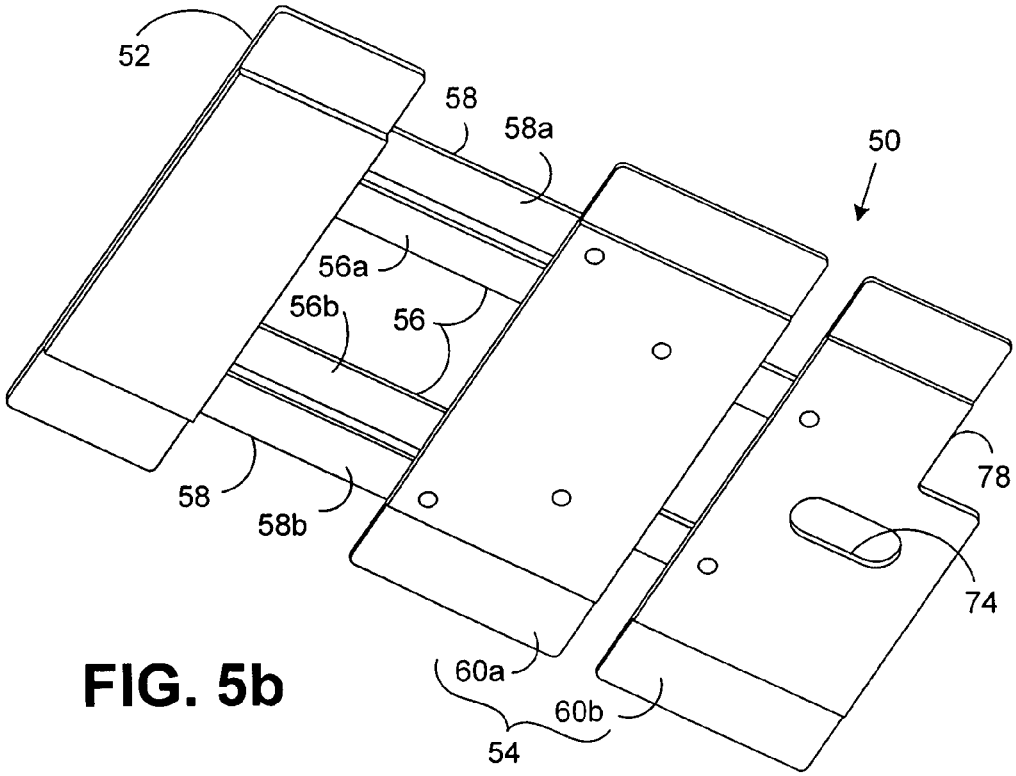
FIG. 5*b* is a perspective view of the underside surface of the platen structure shown in FIG. 5*a*.

To facilitate separation and referring to FIG. 4, an air pressurization system 36 may be employed to introduce a thin layer of air between individual sheets of the stacked sheet material 24. More specifically, a pair of air plenums 40*a*, 40*b* may be disposed on each side of the feed support deck 16 to introduce pressurized air edgewise into the stack sheet material 24. In the described embodiment, a pressure source 44 is disposed in fluid communication with each of the air plenums

40*a*, 40*b*, to supply air to a plurality of lateral nozzles or apertures 46 which direct air laterally into the stacked sheet material 24.

The cut sheet feeder, therefore, includes an inclined transport deck 14 upstream of the feed support deck 16 to produce a cantilevered sheet material delivery profile. The delivery profile causes the sheet material 24 to be "self-supporting" as sheets are transferred to the feed support deck 16. The cantilevered delivery profile reduces the weight acting on the stacked material 24 and minimizes the friction developed between individual sheets of material. As such, the inclined deck configuration facilitates separation of the sheets 24 by the rotating vacuum drum 28. In contrast, prior art sheet feeders employ transport decks which are substantially parallel to and co-planar with the feed support deck. As such, the weight and friction acting on the lowermost sheet, i.e., the sheet in contact with the feed support deck is a function of the collective weight of those sheets (shingled as they may be) which bear on the area profile of the sheet material. It will be appreciated that increased friction between sheets (and/or between the sheet material and feed support deck) will potentially complicate singulation/separation operations by causing multiple sheets to remain friction bound, i.e., moving as one sheet across the vacuum drum as it rotates.

Additionally, the introduction of pressurized air, i.e., air introduced or blown into at least one side of the stacked sheet material 24, functions as a bearing to separate and lubricate the sheets 24 within the stacked material. The air lubrication, therefore, serves to reduce friction acting on or between the sheets 24 thereby facilitating separation/singulation by the rotating vacuum drum 28.

The foregoing discussion principally addressed the conveyance of sheet material 24 from an inclined transport deck 14 to a feed support deck 16 for the purpose of reliably separating/singulating the sheet material 24. However, in addition to reducing friction between sheets 24, an equally important aspect of a sheet feeder 10 relates to reliably feeding all sheets of material, i.e., including the final or last sheets in the stack. That is, inasmuch as the final or last sheets may experience a different set of loading conditions, due to a lessening of sheet material/stack weight, the sheet feeder 10 must accommodate variable loading conditions to ensure reliable sheet run out.

In FIGS. 5*a*, 5*b*, 6*a* and 6*b*, the present invention employs a platen structure 50 to perform several functions, some being unique to the configuration of the inventive cut sheet feeder. More specifically, the platen structure 50 prevents the shingled arrangement of stacked sheets from separating or spreading due to the angle formed by shingling the stack. This function becomes especially critical as the stacked sheet material 24 is fed up the inclined transport deck 14. Furthermore, the platen 50 serves to conform to the shape of the stacked sheet material 24, even as the material arcs to form the cantilevered delivery profile. Moreover, the platen structure 50 equilibrates or compensates for the reduction in sheet material weight as the sheet feeder 10 nears the end of a job run, i.e., as the final sheets are separated/singulated.

The platen 50 is a multi-element structure comprising a drive segment 52 and a weighted segment 54 which are tied together by a compliant coupling 56. The compliant coupling 56 is flexible along a first axis 56A, e.g., permitting relative angular displacement of at least forty-five degrees about long the axis 56*a*, but maintains the spacing between segments 52, 54, and relative angular displacement, about axes 56B, 56C orthogonal to the first axis 56A. More specifically, the compliant coupling permits flexure with enables the segments 52, 54 to follow the contour of the delivery profile, i.e., requiring a relatively large angular displacement, e.g., forty-five degrees or greater, while inhibiting twist about the longitudinal axis 56B and/or skewing about the vertical yaw axis 56C. For the purposes of defining the compliance characteristics of the coupling 56, bending motion about the transverse axis 56A is accommodated to include angles greater than forty-five degrees (45°) and up to ninety degrees (90°). In contrast, twist and/or skewing motion about axes 56B, 56C is limited to about thirty degrees (30°) or less.

While the drive and weighted segments perform additional functions associated with stability and force normalization, it will facilitate the discussion to refer to each segment by a discriminating characteristic. In the described embodiment, the drive segment 52 is a flat or planar rectangular element which is disposed in contact with the conveyor belt(s) 22 (see FIGS. 6*a* and 6*b*) of the transport decks 12, 14. As such, a frictional interface is produced which transfers the drive motion of the belts 22 to the weighted segment 54 by means of the resilient straps 56. Furthermore, the propensity of the shingled stack to slide back or apart is resisted by the in-plane stiffness of the straps 56. To enhance the frictional interface, a high friction elastomer may be adhered or otherwise affixed to the face surface of the drive segment 52 of the platen structure 50.

The weighted segment 54 of the platen structure 50 may be separated into two or more sections 60*a*, 60*b* and spaced-apart for the purpose of following the contour of the cantilevered delivery profile. That is, depending upon the size of the sheet material and the amount of curvature, it may be desirable to section the weighted segment 54 to more evenly distribute the weight of the platen structure 50 on the stacked sheet material 24. It will be appreciated that as the surface area in contact with the stacked sheet material 24 grows or increases, the local forces, normal to the surface of the platen 50 decreases. In the described embodiment, the tandem sections 60*a*, 60*b* may be connected by an extended segment of the resilient straps 56, although additional dedicated straps or other flexible materials may be used to maintain a flexible coupling therebetween.

The flexible straps 56 are configured and fabricated to exhibit certain structural properties which (i) facilitate drive by the conveyor belts 22, (ii) prevent individual sheets from lifting or becoming lodged between one of the platen segments 54, 56 and straps 56, (iii) enable the platen 50 to follow the contour of the delivery profile, and (iv) prevent damage/disruption of the sheet material as it is singulated. More specifically, the flexible straps 56 are stiff in-plane to maintain the separation distance between the various segments or sections 52, 60*a*, 60*b* and transfer the compressive load necessary to drive or "push" the tandem sections 60*a*, 60*b* as the conveyor belts 22 transport the stacked sheet material 24. Furthermore, the straps 56 are flexible out-of-plane to enable the sections 60*a*, 60*b* to rest on the stacked sheet material 24 irrespective the curvature produced by the cantilevered delivery profile. Moreover, the straps 56 may include a low friction exterior surface to prevent the straps 56 from chaffing, scuffing or wrinkling the stacked sheet material 24. More specifically, the straps 56 may include a structural metallic core and a low friction exterior surface. The exterior surface may be produced by adhering, or otherwise affixing, a low friction thermoplastic coating or surface treatment.

Figure 6A:
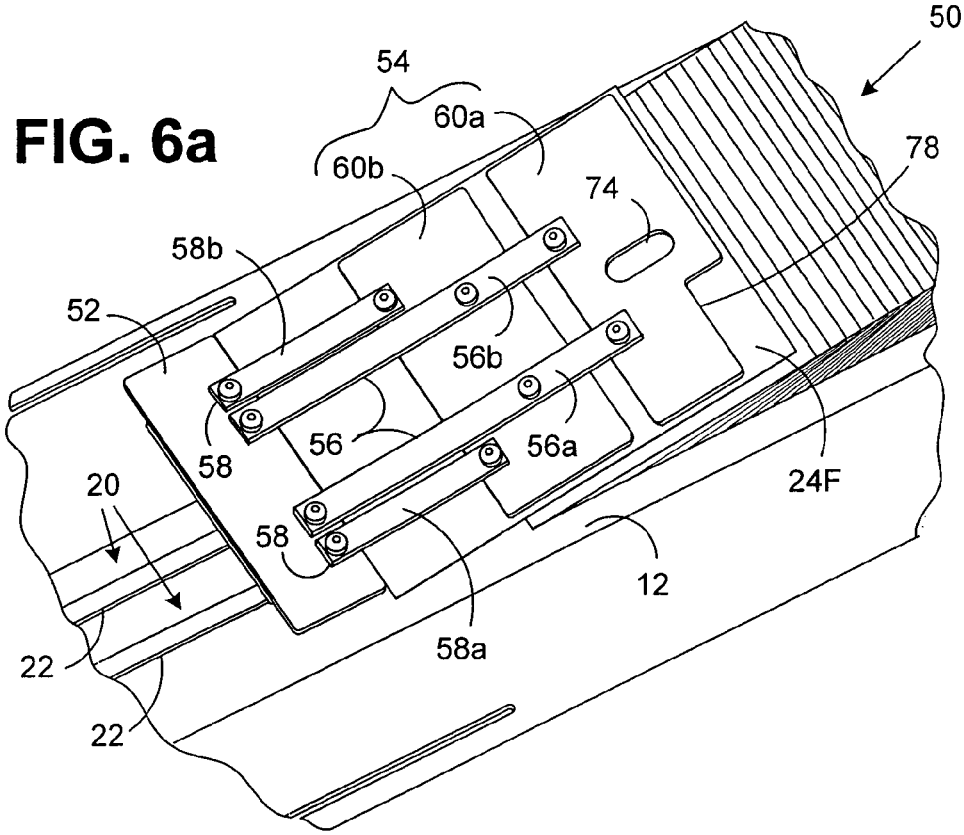
FIG. 6*a* depicts the platen structure disposed in combination with the stacked sheet material at a first location along the horizontal transport deck of the cut sheet feeder.
Figure 6B:
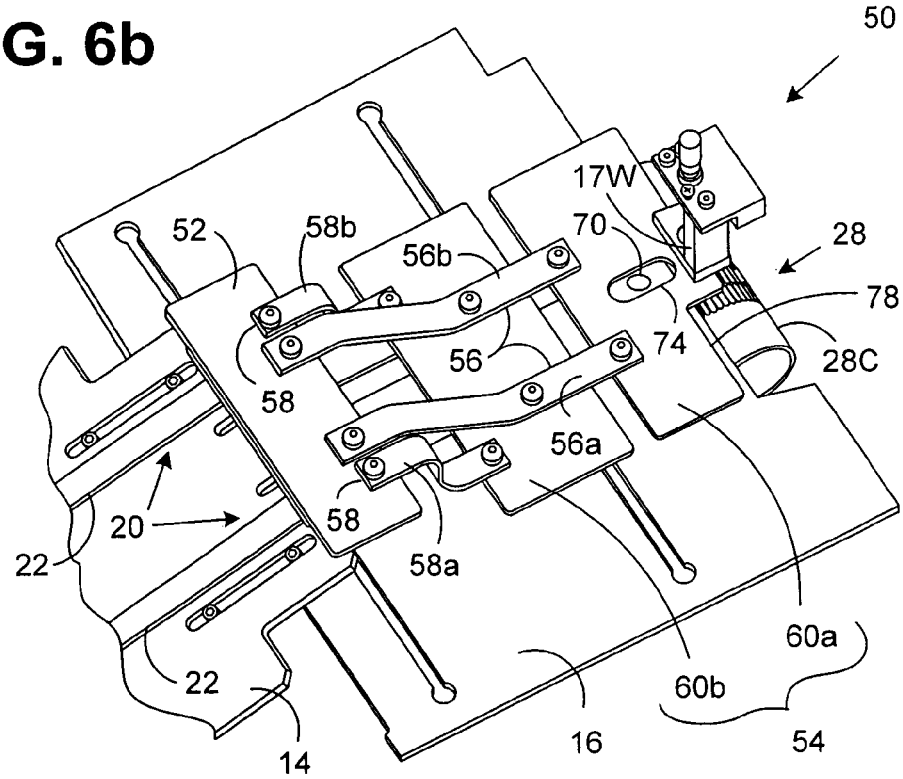
FIG. 6*b* depicts the platen structure disposed in combination with the stacked sheet material at a second location spanning the transition from the inclined transport deck to the feed support deck.

In the described embodiment, the platen structure 50 includes inboard straps 56*a* which tie all of the platen segments 52, 54 and sections 60*a*, 60*b* together. However, to prevent an edge of a sheet from lifting away from the remainder of the stack or lodging between the straps 56*a* and one of the segments 52, 54, it may be desirable to incorporate highly flexible straps 58*a*, 58*b* outboard of and to each side of the inboard straps 56*a*, 56*b*. These straps, best shown in FIG. 6*b*, are fabricated from pure elastomer material, to guide or maintain the shape of the stack, especially as the stack negotiates the transition between the inclined and feed support decks 14, 16.

In one embodiment of the platen structure 50, an optical sensing device is employed to monitor the presence of sheet material 24, i.e., sense when a final sheet has been separated or transported from the feed support deck 16. This system (best seen in FIG. 6*b*) typically includes a photocell 70 to monitor the reflected light energy which will be highest when the photocell 70 is covered by sheet material 24 and low, or at least lower, when the sheet material 24 is absent and no longer reflects light energy, i.e., reflected light from reaching the photocell 70. To prevent the platen structure 50 from defeating or rendering the optical sensing device ineffective, the weighted segment 52 may include an aperture, transparent window or other non-reflective surface light transmitting means. In the described embodiment, the first tandem section 60*a* includes an elliptical aperture 74 which aligns with the photocell when the last sheet is singulated by the rotating vacuum drum.

While the optical sensing system is useful for determining when the last sheet of the stack material 24 has been singulated, it is also necessary to monitor when additional sheet material 24 should be added to the cut sheet feeder 10, i.e., to continue operations without interruption. Accordingly, it is common practice to incorporate a system for measuring the thickness of the stacked sheet material 24. The system monitors when the stack thickness has reached a threshold low thickness level indicative that the feed support deck 16 requires additional sheet material for continued operation. Typically, a pivoting arm/wheel (not shown) contacts a face surface of the stacked sheet material 24 while a rotary encoder (not shown) measures the angle of the pivot arm/wheel. Upon reaching a threshold angle, a signal activates the conveyor belts 22 to supply additional material to the feed support deck 16.

Similar to the elliptical aperture 74 for accommodating the operation of the optical sensing system, one of the tandem sections 60*a*, 60*b* of the platen structure 50 may incorporate a relief or cut-out 78 to accommodate the operation of the thickness measurement system. In the described embodiment, the relief or cut-out 78 is formed in the first tandem section 60*a* and has a substantially rectangular shape. As such, a segment of the face surface 24F (see FIG. 6*a*) of the stacked sheet material 24 is exposed to facilitate contact with a pivoting arm/wheel.

In summary, the inventive platen structure 50 augments the reliability of a cut sheet feeder 10, particularly a feeder having an inclined transport deck. The platen structure 50 prevents the shingled arrangement of stacked sheets from separating or spreading, especially when such sheets climb an inclined transport deck or surface. Furthermore, the platen structure 50 conforms to the shape of the stacked sheet material 24, even as the material 24 develops a cantilevered delivery profile. Moreover, the platen structure 50 compensates for a reduction in sheet material weight as the final sheets are separated/singulated. Finally, the platen structure 50 may be adapted to accommodate the use of various pre-existing systems, e.g., optical sensing or thickness measurement systems.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is:

1. A cut sheet feeder for feeding stacked sheets of material along a feed path, comprising:

a feed support deck defining a planar surface for supporting the stacked sheet material;

a transport deck defining an inclined surface relative to the planar surface of the feed support deck; the inclined surface operative to transport additional sheet material to the feed support deck and produce a cantilevered sheet material delivery profile, the transport deck including a conveyor belt having a drive surface, and further comprising a platen structure having a weighted segment for engaging a rearwardly facing surface of the stacked sheet material, a drive segment for engaging the drive surface of the conveyor belt, and a resilient strap tying the segments together, the weighted segment including first and second tandem sections, the tandem sections being spaced apart and connected by an extended segment of the resilient strap, the tandem sections and resilient strap operative to follow the contour of the cantilevered delivery profile and a rotating element operative to engage a surface of the stacked sheet material, and separate a single sheet from other sheet material supported on the feed support deck, wherein the cantilevered delivery profile of the sheet material minimizes friction developed between individual sheets of material to facilitate separation of the sheets by the rotating element, and wherein the conveyor belt transfers motion to the weighted segments via the resilient strap.

2. The cut sheet feeder according to claim 1 wherein the inclined surface defines an acute angle β relative to the planar surface, the acute angle β being within a range of about sixteen degrees (16°) to about thirty degrees (30°).

3. The cut sheet feeder according to claim 2 wherein the acute angle β is within a range of about sixteen-degrees (16°) to about twenty-four degrees (24°).

4. The cut sheet feeder according to claim 1 wherein the transport deck includes first and second transport deck sections, the first transport deck section having a horizontal surface and the second transport deck section defining the inclined surface.

5. The cut sheet feeder according to claim 1 further comprising an air pressurization device disposed in combination with the feed support deck for introducing pressurized air between the sheets of the stacked material.

6. The cut sheet feeder according to claim 1 wherein the rotating element includes a vacuum drum defining a cylindrical surface having plurality of perforations and a vacuum source disposed in fluid communication with the perforations, the vacuum source operative to develop a pressure differential across the sheet material and draw a leading edge segment of a sheet into frictional engagement with the cylindrical surface of the vacuum drum.

7. The cut sheet feeder according to claim 1 wherein the cut sheet feeder further comprises an optical sensing device for sensing the absence of sheet material to discontinue sheet feeder operations, and wherein the first tandem section includes an aperture for alignment with the optical sensing device.

8. The cut sheet feeder according to claim 5 wherein the air pressurization device includes a source of pressurized air and pair of linear plenums disposed in fluid communication with the pressurized air source, each linear plenum having a plurality of inwardly facing nozzles for delivering pressurized air laterally between the sheets of the stacked material.

9. The cut sheet feeder according to claim 1 wherein the drive segment of the platen includes a high friction elastomer along a side facing and engaging the drive surface of the conveyor belt.

10. The cut sheet feeder according to claim 1 wherein the resilient strap includes first and second elongate elements, each element having a core structure which is stiff in-plane, flexible in out-of-plane and having a low friction exterior surface along a side facing the stacked sheet material.

11. The cut sheet feeder according to claim 10 wherein the core structure is fabricated from a metal material and wherein the low friction exterior surface is fabricated from a thermoplastic material.

12. A cut sheet feeder for feeding stacked sheets of material along a feed path, comprising:

a feed support deck defining a planar surface for supporting the stacked sheet material;

a transport deck defining an inclined surface relative to the planar surface of the feed support deck; the inclined surface operative to transport additional sheet material to the feed support deck and produce a cantilevered sheet material delivery profile, the transport deck including a conveyor belt having a drive surface, and further comprising a platen structure having a weighted segment for engaging a rearwardly facing surface of the stacked sheet material, a drive segment for engaging the drive surface of the conveyor belt, and a resilient strap tying the segments together, the weighted segment including first and second tandem sections, the tandem sections being spaced apart and connected by an extended segment of the resilient strap, the tandem sections and resilient strap operative to follow the contour of the cantilevered delivery profile a rotating element operative to engage a surface of the stacked sheet material and separate a single sheet from other sheet material supported on the feed support deck, the rotating element including a vacuum drum having plurality of perforations and a vacuum source disposed in fluid communication with the perforations, the vacuum source operative to develop a pressure differential across the sheet material and draw a leading edge segment of a sheet into frictional engagement with a cylindrical surface of the vacuum drum and an air pressurization device disposed in combination with the feed support deck for introducing pressurized air between the sheets of the stacked material, wherein the cantilevered delivery profile in combination with the air pressurization device minimizes friction developed between individual sheets of the stacked material to facilitate separation of the sheets by the rotating element, and wherein the conveyor belt transfers motion to the weighted segment via the resilient strap.

13. The cut sheet feeder according to claim 12 wherein the inclined surface defines an acute angle β relative to the planar surface, the acute angle β being within a range of about sixteen degrees (16°) to about thirty degrees (30°).

14. The cut sheet feeder according to claim 13 wherein the acute angle β is within a range of about sixteen-degrees (16°) to about twenty-four degrees (24°).

15. The cut sheet feeder according to claim 12 wherein the air pressurization device includes a source of pressurized air and pair of linear plenums disposed in fluid communication with the pressurized air source, each linear plenum having a plurality of inwardly facing nozzles for delivering pressurized air laterally between the sheets of the stacked material.

16. The cut sheet feeder according to claim 15 wherein the weighted segment includes a relief groove disposed along edges adjacent to each linear plenum.

17. The cut sheet feeder according to claim 12 wherein the cut sheet feeder further comprises an optical sensing device for sensing the absence of sheet material to discontinue sheet feeder operations, and wherein one of the tandem sections includes an aperture for alignment with the optical sensing device.

18. The cut sheet feeder according to claim 12 wherein the cut sheet feeder further comprises a thickness measurement system for measuring the thickness of the stacked sheet material, and wherein the first tandem section includes a cut-out for accommodating contact by the thickness measurement system with a face surface of the stacked sheet material.

* * * * *